US005645376A

United States Patent [19]

Taki

[11] Patent Number: 5,645,376

[45] **Date of Patent: *Jul. 8, 1997**

[54] SOIL SOLIDIFICATION APPARATUS WITH A SHEAR BLADE OF ADJUSTABLE LENGTH AND ROTATION SPEED FOR CREATING A RIBBED SOIL-CEMENT PILE

[76] Inventor: Osamu Taki, P.O. Box 1297, Belmont, Calif. 94002

[ * ] Notice: The term of this patent shall not extend beyond the expiration date of Pat. No. 5,441,353.

[21] Appl. No.: 388,293

[22] Filed: Feb. 14, 1995

Related U.S. Application Data

[63] Continuation-in-part of Ser. No. 115,228, Sep. 1, 1993, Pat. No. 5,411,353.

[51] Int. Cl.[6] ..... E02D 3/12

[52] U.S. Cl. ..... 405/241; 405/233; 405/269

[58] Field of Search ..... 405/233, 240, 405/241, 248, 252.1, 253, 269, 266; 175/394

[56] References Cited

U.S. PATENT DOCUMENTS

| | | | |
|---|---|---|---|
| 2,783,974 | 3/1957 | Veasman | 175/394 X |
| 4,902,172 | 2/1990 | Fukuda | 405/269 |
| 5,006,016 | 4/1991 | Fukuda | 405/240 |
| 5,295,769 | 3/1994 | Sano | 405/266 |
| 5,411,353 | 5/1995 | Taki | 405/241 |

FOREIGN PATENT DOCUMENTS

| | | | |
|---|---|---|---|
| 36592 | 3/1980 | Japan | 405/241 |
| 521 | 1/1983 | Japan | 405/248 |
| 154214 | 9/1984 | Japan | 405/240 |
| 125017 | 5/1990 | Japan | 405/241 |
| 213514 | 8/1990 | Japan | 405/241 |
| 212506 | 9/1991 | Japan | 405/241 |
| 247923 | 9/1993 | Japan | 405/241 |

*Primary Examiner*—John A. Ricci
*Attorney, Agent, or Firm*—Fenwick & West, LLP

[57] ABSTRACT

A soil mixing apparatus that requires less drilling force comprises a shaft, a plurality of cutting blades, an excavation blade, an auger bit, a shear blade having an extendible finger. The cutting blades, excavation blade and auger bit are attached to rotate with the shaft. The shear blade is attached at a fixed longitudinal position along the shaft. The shear blade provides a variable length by attaching different length fingers that are adjustable to the soil conditions in which the mixing apparatus is used. The shear blade is also mounted to the shaft at an angle such that the shear blade rotates in the same direction as the excavation blade and the cutting blades, but at a much slower rotation rate.

14 Claims, 8 Drawing Sheets

SOIL SOLIDIFICATION APPARATUS WITH A SHEAR BLADE OF ADJUSTABLE LENGTH AND ROTATION SPEED FOR CREATING A RIBBED SOIL-CEMENT PILE

CROSS-REFERENCE TO RELATED APPLICATION

This application is a continuation-in-part of U.S. patent application, Ser. No. 08/115,228, filed Sep. 1, 1993, entitled "A Soil Solidification Apparatus With A Shear Blade Of Adjustable Length And Rotation Speed For Creating A Ribbed Soil-Cement Pile", now U.S. Pat. No. 5,411,353.

BACKGROUND OF THE INVENTION

1. Field of the Invention

The present invention relates to an apparatus for drilling and in situ mixing to construct soil-cement piles for soil solidification purposes. In particular, the present invention relates to a shear blade for a mixing apparatus that requires less vertical force for drilling and withdrawing the apparatus. The apparatus of the present invention also relates to devices for producing ribbed soil-cement piles.

2. Description of Related Art

There are a variety of methods used in the prior art to increase the ability of the ground to support buildings and other structures. One such conventional method for increasing the support provided by the ground is the construction of piles or columns of soil and cement. These piles can be created by excavating soil, inserting a cylindrical casing, and then filling the casing with a combination of excavated soil and cement. Other methods in the prior art create such piles by in situ mixing of the soil and cement. One type of pile used for soil solidification purposes is an end bearing pile. End bearing piles have a generally cylindrical shape and a length that extends from the surface of the ground downward to bedrock, or to a point where the soil is hard and will not settle significantly. However, end bearing piles are typically quite long and thus expensive to construct. Therefore, their use has been limited to larger multiple level buildings where the ground must be firm and settling is unacceptable.

Friction piles have also been used in the prior art in an attempt to provide a more cost effective means of soil solidification. Friction piles similarly have a generally cylindrical shape, but have a limited length. The load bearing capacity of such friction piles is determined primarily by the friction between the soil and the exterior surface of the pile. One key aspect of friction piles is to provide good surface friction. Friction piles are constructed in soft soil and will allow some settling because they do not rest on bedrock or hardened soil due to their limited length. Therefore, their primary use has been limited to smaller housing structures with one or two levels where downward movement of the pile due to settling of the ground is tolerable.

One problem in the prior art, especially for friction piles, is the bearing capacity provided. Especially in soft soil conditions, the pile will not provide the desired bearing capacity. Therefore, more piles must be constructed to increase the density of piles per square foot, and thus, increase the overall bearing capacity per square foot. However, each additional pile that must be constructed requires significant time and effort. Therefore, there is a need for a system and method that can be used to increase the bearing capacity or the frictional resistance to vertical movement of each pile, and thereby eliminate the need to add more piles to increase the overall bearing capacity.

The prior art provides a variety of conventional drilling devices for drilling into the ground and mixing the soil with grout or additives for soil improvement purposes. A major drawbacks of such existing drilling devices is that they can only be used in very soft soil conditions and for shallow drilling. Soil that is hard prevents the use of these existing drilling devices. For example, in situations where the soil has regions that are very compact and dense, existing drilling devices cannot be used. Such hard soil conditions require that the downward force applied to the drilling apparatus, in particular the shear blade, be increased significantly to overcome the huge resistance applied to the shear blade as the drilling apparatus penetrates downward into the soil. When the compact areas of soil are encountered, it is difficult, if not impossible, to move the drilling apparatus further downward because the ends of the shear blade cannot penetrate the compact areas of soil. While the blades and the other portions of the drilling apparatus can be strengthened to increase their ability to penetrate the soil, the cost and time of such reinforcement of the apparatus is not economically feasible.

Another problem with the prior art drilling systems and very compact soil is the difficulty in controlling the drilling direction. Additional resistance encountered by the drilling device in very compact soil requires that additional downward force be applied to the drilling device. This additional downward force pushes the ends of the shear blade through the hardened soil. However, this additional downward force often causes the shaft to flex or bend. The bending of the shaft in turn causes the auger bit to veer off its original linear path making it very difficult to drill a pile along a straight line in the vertical direction as desired. Moreover, the bending of the shaft increases the likelihood that the shaft will break. Thus, the shear blades of the prior art are particularly problematic for other than normal soft conditions.

Therefore, there is a need for a drilling apparatus that is adaptable to a variety of soil types and that reduces the amount of downward force applied to the apparatus. There is also a need for a drilling apparatus that provides improved control over the drilling direction. Finally, there is a need for an apparatus that can create soil-cement piles with increased surface friction.

SUMMARY OF THE INVENTION

The present invention overcomes the deficiencies of the prior art by providing an in situ mixing apparatus that requires less vertical drilling force for drilling and withdrawing the apparatus from the ground. The mixing apparatus also produces ribbed soil cement columns. The mixing apparatus of the present invention preferably comprises a shaft, an excavation blade, a plurality of cutting blades, an auger bit, and a shear blade. The excavation blade, the cutting blades and the auger bit are fixably attached to rotate with the shaft. In contrast, the shear blade is attached at a fixed longitudinal position along the shaft but not directly connected. The shear blade of the present invention advantageously provides a variable diameter that is adjustable to the soil conditions in which the drilling apparatus is used. The shear blade of the present invention is also mounted to the shaft at an angle $\alpha$ such that the shear blade rotates in the same direction as the auger bit, the excavation blade and the cutting blades; but at a slower rotation rate. In the preferred embodiment, the angle $\alpha$ at which the shear blade is mounted to the shaft is greater that the angle $\beta$ at which the cutting blades are mounted to the shaft (i.e., $\alpha>\beta$). The fingers and tips of the shear blade may also have a variety of configurations that are used to properly adjust and control the rotation rate of the shear blade. The variable shape of the tips greatly reduces the downward force that needs be applied to the drilling apparatus and controls the rotation rate of the shear blade. The length of the fingers can also be adjusted to change the size of the ribs. Other features and advantages of the present invention will become apparent from the following description taken in conjunction with the accompanying drawings.

DETAILED DESCRIPTION OF THE PREFERRED EMBODIMENTS

Figure 1:
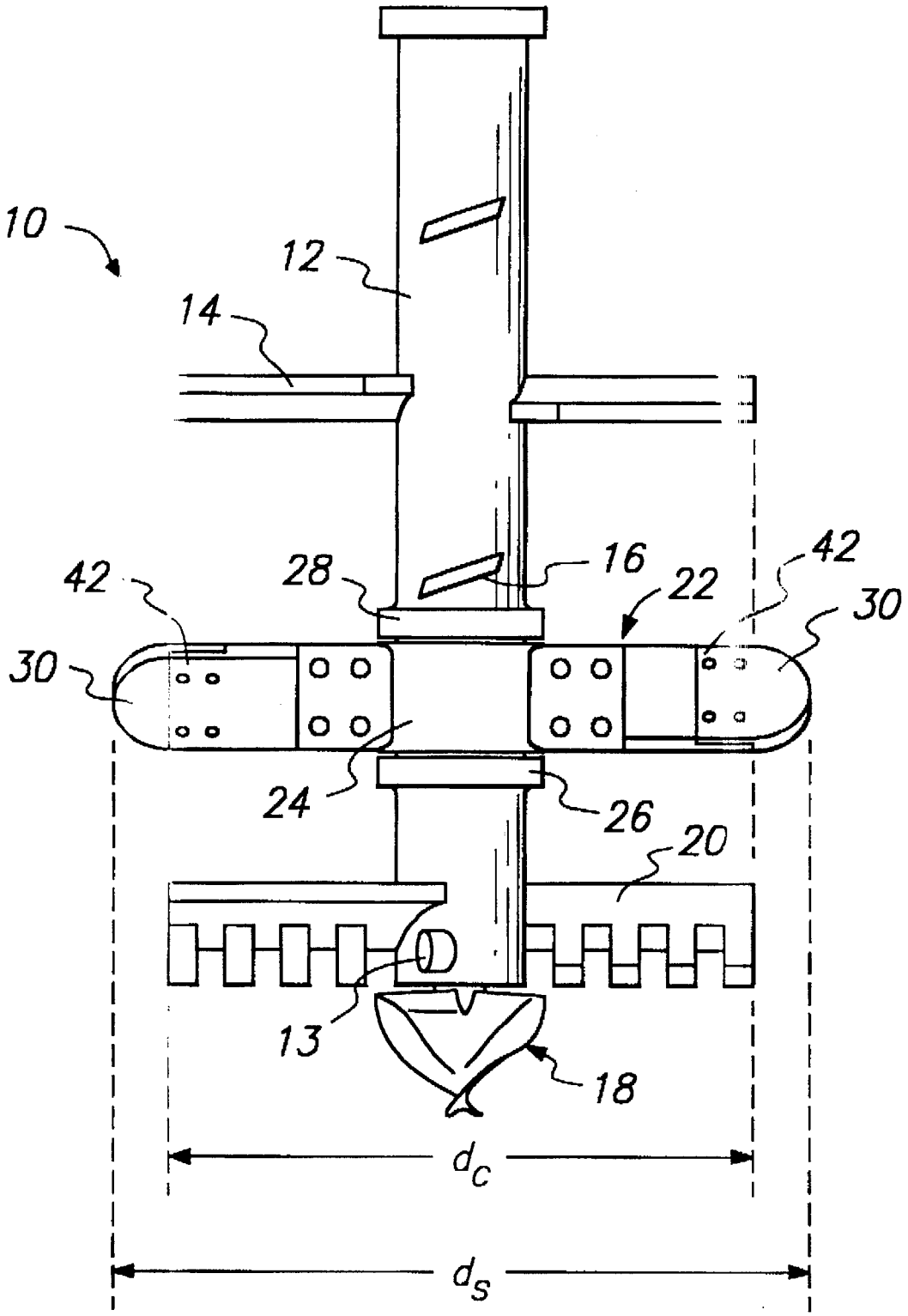
FIG. 1 is a front perspective view of a preferred embodiment of the drilling apparatus of the present invention.

An inventive drilling apparatus 10 according to the present invention is shown in FIG. 1. The preferred embodiment of the drilling apparatus 10 of the present invention comprises a shaft 12, a plurality of cutting blades 14, 16, an auger bit 18, an excavation blade 20, and a shear blade 22 with an extendible finger 30. The shaft 12 is preferably hollow and provides a port 13 proximate the first end of the shaft 12. The hollow and the port 13 allow cement and other adhesives to be injected through the shaft 12 and mixed with the soil as the apparatus 10 drills down and is withdrawn. The auger bit 18 is mounted on a first end of the shaft 12 such that the auger bit 18 rotates with the shaft 12. Adjacent to the auger bit 18, the excavation blade 20 is fixed to the shaft 12 and rotates with the shaft 12. The excavation blade 20 has a plurality of teeth that extend downward for cutting into the soil and loosening it as the apparatus 10 is forced downward into the soil. A pair of cutting blades 14 and 16 are also attached to the shaft 12 at a distance away from the first end of the shaft 12. The cutting blades 14, 16 extend radially outward from the shaft 12 and are preferably positioned perpendicular to each other when viewed from the top or bottom. The cutting blades 14, 16 are used to provide additional agitation and mixing of the soil as the apparatus 10 is moved upward or downward. The cutting blades 14, 16, and the excavation blade 20 preferably have the same length to create a pile of loosened soil with a diameter $d_c$.

The shear blade 22 of the present invention is preferably positioned along the shaft 12 in between the cutting blade 16 and the excavation blade 20. Unlike the other blades 14, 16, and 20, the shear blade 22 is not fixably mounted to rotate with the shaft 12. The base members 42 of the shear blade 22 are attached to the shaft 12 by a housing 24, first embodiment. The first embodiment of the housing 24 preferably has a diameter slightly larger than the diameter of the shaft 12. Thus, as the shaft 12 rotates, the shear blade 22 is not forced to rotate at the same rate as the shaft 12. However, the friction between the first embodiment of the housing 24 and the shaft 12 applies some rotational force to the shear blade 22 as the shaft 12 rotates. Additional and more substantial rotational force is applied to the shear blade 22 by the soil due to movement of the soil by the cutting blades 14, 16 and the excavation blade 20. The first embodiment of the housing 24, and thus the shear blade 22, are held in place along the longitudinal axis of the shaft 12 by a pair of supports 26, 28. The supports 26, 28 are mounted to the shaft 12. There is a support 28 positioned above and a support 26 positioned below the first embodiment of the housing 24. The supports 26, 28 move the shear blade 22 up and down with movement of the apparatus 10. The shear blade 22 in the present invention rotates at a much slower rate that the other blades 14, 16, 20. In an exemplary embodiment, the shear blade 22 rotates once per 20 rotations of the cutting blade 14 for hard soil and once per 40 rotations of the cutting blade 14 for soft soil. Thus, the soil is mixed as the other blades 14, 16, 20 rotate in parallel planes with respect to the relatively stationary shear blade 22.

Figure 2:
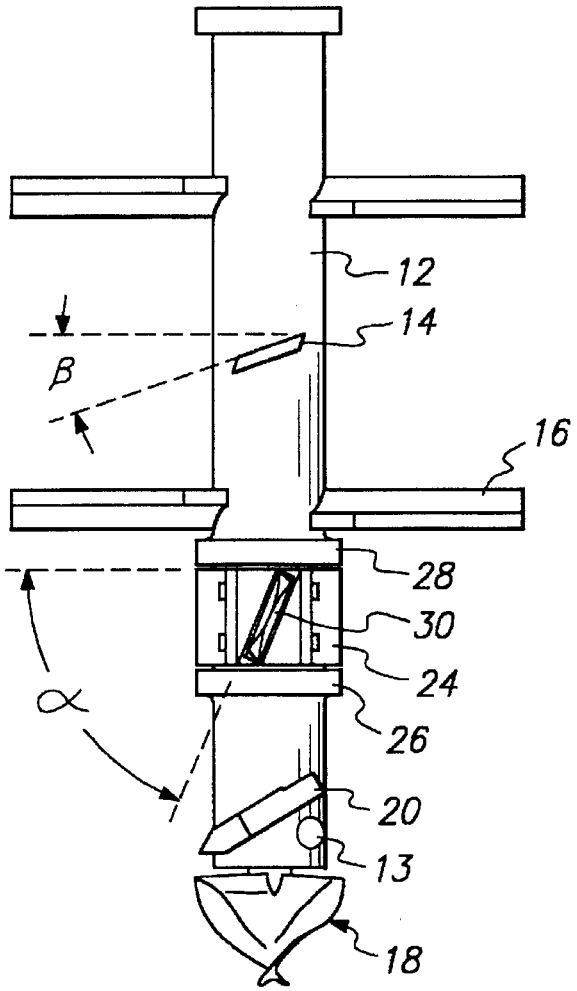
FIG. 2 is a side view of the preferred embodiment of the drilling apparatus of the present invention.

Referring now to FIG. 2, the angle at which the shear blade 22 is attached to the shaft 12 with respect to a horizontal planes is shown. In the preferred embodiment of the present invention, the angle at which the shear blade 22 is attached to the shaft 12 can also be adjusted to control the rotation rate of the shear blade 22. The rotation rate of the shear blade 22 determines the amount of resulting force that will be applied to the shear blade as well as the linear spacing between ribs on the pile constructed with the apparatus 10. In the preferred embodiment, the shear blade 22 is mounted at an angle α from a horizontal plane. In an exemplary embodiment, the angle α is in the range of 70° to 90° for soft soil and in the range of 45° to 75° for hard soil. Similarly, the present invention also allows the angle β at which the cutting blades 14, 16 and the excavation blade 20 are attached to the shaft 12 to be modified. In the exemplary embodiment, the angle β ranges from 10° to 25° for soft soil, and 5° to 20° for hard soil. Therefore, the adjustments to both the cutting blades 14, 16, 20 and the shear blade 22 will maintain the difference between the rotation rates of the cutting blades 14, 16, 20 and the shear blade 22. Thus, there continues to be a shearing effect to mix the soil even though the shear blade 22 rotates.

Figure 3A:
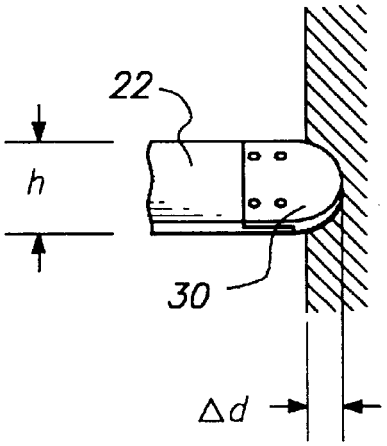
FIGS. 3A and 3B are sectional side views of the shear blade of the present invention with different length fingers attached.
Figure 3B:
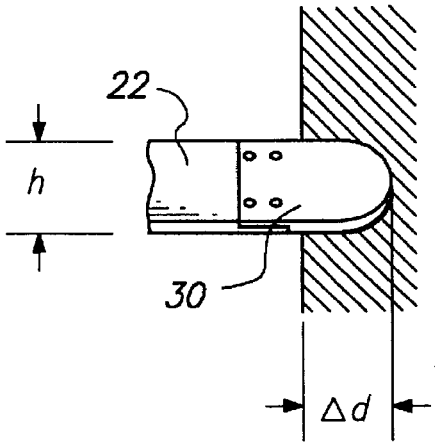

The present invention advantageously provides a shear blade 22 with extendible fingers 30 that rotate to cut through the soil as the apparatus 10 is forced up and down. The shear blade 22 and fingers 30 preferably have a height (h). The pile corresponding to the shear blade 22 and the extendible fingers 30 has a diameter $d_s$. The shear blade 22 and extendible fingers 30 have a combined length equal to diameter $d_s$ that is slightly greater than the diameter $d_c$ of the other blades 14, 16, 20. This difference in diameter ($\Delta d = d_s - d_c$) and the soil conditions determine the amount of resistance to rotation that the shear blade 22 will provide. In the present invention, the diameter $d_s$ of the shear blade 22 is advantageously variable by Changing the length of the fingers 30. The fingers 30 preferably vary in length such that Δd ranges between zero and 12 inches. Thus, the resistance to rotation provided by the shear blade 22 can be kept constant by changing the length of the fingers 30 attached at distal ends of the shear blade 22 according to the type of soil with which the apparatus is being used. For example, in hard soil, the distance the shear blade 22 extends beyond the diameter $d_c$ is reduced as shown in FIG. 3A because hard soil has a greater resistance to movement. In an exemplary embodiment, the difference (Δd) between the diameters $d_s$ and $d_c$ is less than two inches. For soft soil, the distance the shear blade 22 extends beyond the diameter $d_c$ is increased as shown in FIG. 3B since soft soil provides less resistance to rotation. In an exemplary embodiment, the difference (Δd) between the diameters $d_s$ and $d_c$ is between two and six inches for soft soil conditions.

Figure 4A:
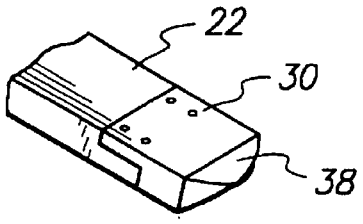
FIGS. 4A–4D show four embodiments for the tips of the finger of the shear blade of the present invention.
Figure 4B:
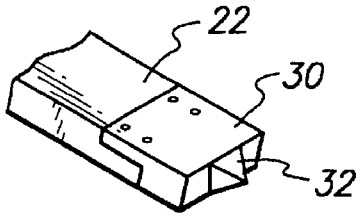
Figure 4C:
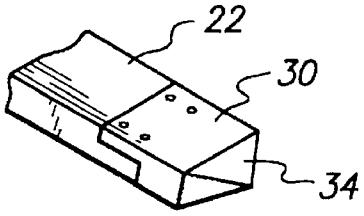
Figure 4D:
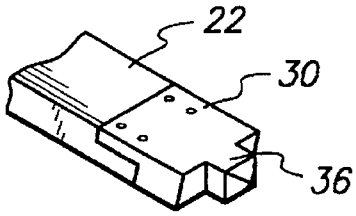

FIGS. 4A–4D show various embodiments for the outer tips 38, 32, 34, 36 on the fingers 30 of the shear blade 22. Each of the figures illustrates a side view and an end view for the tips 38, 32, 34, 36 of the present invention. In the preferred embodiment shown in FIG. 4A, a tip 38 has a disk shape with a single edge on the outermost side and the tip 38 width increasing until it matches the width of the shear blade 22 to which it is attached. FIG. 4B shows a second embodiment for the tip 32 that is particularly useful for hard soil. The tip 32 preferably has a pyramid shape with about half the height of the shear blade 22 at its base, and increasing in width until the tip 32 has the same width as the shear blade 22 at its base. FIG. 4C illustrates another embodiment for a tip 34 similar to the embodiment shown in FIG. 4B. The tip 34 has a similar pyramid shape, but the height of the pyramid at its base equals that of the shear blade 22. Finally, FIG. 4D illustrates a rectangular embodiment for a tip 36. The rectangular tip 36 preferably has the same width as the shear blade and a height about half that of the shear blade 22.

Figure 5A:
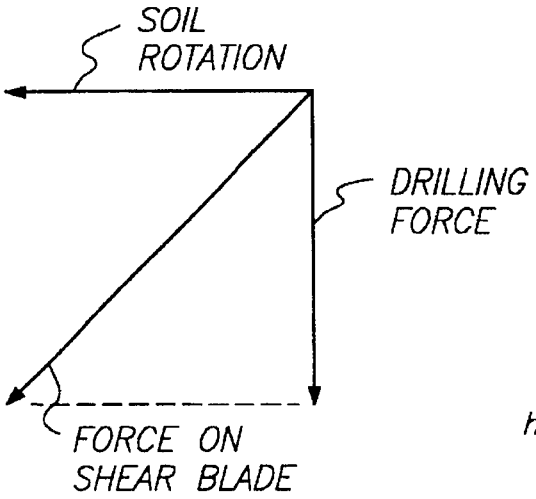
FIG. 5A is diagram of the forces applied to the shear blade and the resulting force.

Referring now to FIG. 5A, one of the advantages of the present invention is more clearly shown. The primary problem in the prior art is that the existing drilling apparatuses are not able to withstand the force that must be applied to drive the shear blade through the unloosened soil. The present invention overcomes this shortcoming of the prior art by allowing the shear blade 22 to rotate, and by applying both a downward drilling force and a rotation force to maximize the resulting force applied to the fingers 30 of shear blade 22 and allow it to cut through soil that has not been loosened. As shown in FIG. 5A, the soil rotation force from friction between the shaft 12 and the first embodiment of the housing 24 as well as from the movement of soil against the shear blade 22 due to force applied by the cutting blades 14, 16 combines with the normal drilling force applied to drive the sheer blade 22 through the soil. This combination greatly increases the amount of force available for the shear blade 22 to cut through the soil.

Figure 5B:
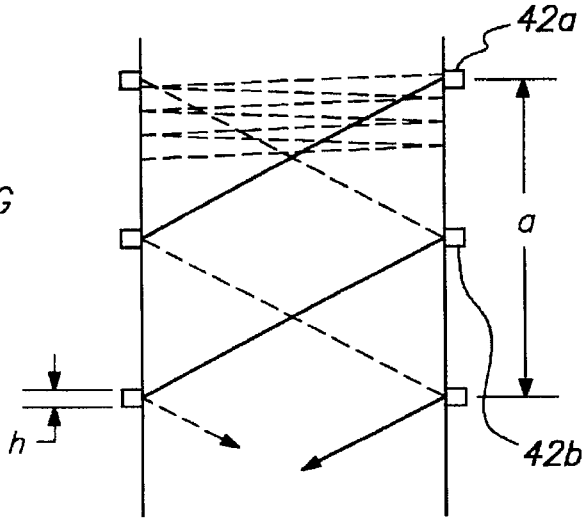
FIG. 5B is a diagram illustrating the number of rotations of the cutting and excavation blades in comparison to the number of rotations of the shear blade according to the present invention.

Another advantage of the present invention is illustrated in FIG. 5B. FIG. 5B is a cross sectional view of the ground remaining in tact after the soil-cement pile has been created using the apparatus 10 of the present invention. As can be seen from FIG. 5B, the rotation rates of the cutting blades 14, 16, and excavation blade 20 differ from the rotation rate of the shear blade 22 by an order of magnitude. In an exemplary embodiment, the shear blade 22 rotates at about 1 RPM while the cutting and excavation blades 14, 16, 20 rotate at about 20–40 RPM. The differential in rotation rates insures that the shear blade 22 will help to shear and mix the soil despite rotation of the shear blade 22. Since the shear blade 22 will rotate about once every minute and the apparatus 10 is able to drill one linear foot per minute, the shear blade 22 of the present invention advantageously creates two ribs per linear foot (one rib is created by each end of the shear blade 22). The vertical distance (a) that the shear blade 22 moves per one rotation is preferably a linear foot but may also be modified by changing the rotation rate and the vertical force applied to the drilling apparatus 10 according to the soil conditions. As has been noted above, the angle α of the shear blade, the length of the finger 30, and the type of tip 32, 34, 36, 38 can be adjusted to the particular soil conditions in which the apparatus 10 is being used to produce the desired number of ribs on the pile.

Figure 5C:
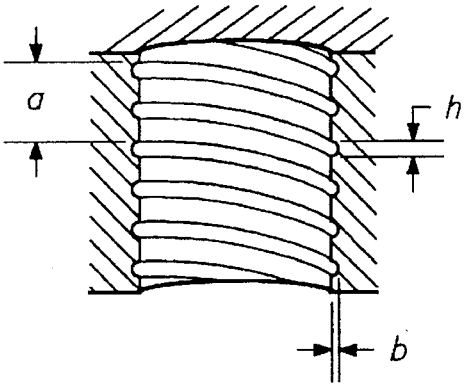
FIG. 5C is a cross sectional side view of the ground remaining undisturbed when using the drilling apparatus of the present invention.

FIG. 5C shows a cross-sectional view of the pile of ground loosened using the mixing apparatus 10 of the present invention. As shown, the shear blade 22 carves a groove/rib in the wall of the pile according to the rate of rotation as the apparatus 10 drills downward. The ribs have a height (h) equal to the height of the shear blade 22. The present invention is particularly advantageous because the spacing between the grooves/ribs can be changed by adjusting the angle of the shear blade 22 as discussed above with reference to FIG. 2. The size of the grooves/ribs on the pile being created can also be adjusted using various length fingers 30 as described above with reference to FIGS. 3A and 3B. As the soil is mixed and injected with cement or other adhesive, a soil pile including these ribs/grooves will be formed. The addition of ribs/grooves to the soil-cement pile is particularly advantageous in several respects. First, the ribs provide the soil pile with added support and stability. The ribs about the periphery of the pile further strengthen the bearing capacity of the pile and hold the pile together. Second, the ribs provide added resistance to vertical movement of the pile. By forming ribs, the surface area and friction of the pile against the existing soil is increased. The bearing capacity of the pile is increased since the ribs increase the circumference and surface area of the pile, and thus, the area over which to distribute the load bearing and uplift on the pile. Third, the interval between ribs and the size of the ribs can be adjusted to the soil conditions with the present invention. By adjusting the angle α of attachment of the shear blade 22, the interval a along the longitudinal axis between ribs can be adjusted. By changing the finger 30 length, and thus, the shear blade length, the distance b that the ribs protrude from the wall of the pile can be adjusted. Thus, for soft soil where the bearing capacity needs to be increased, deep ribs with short intervals can be created using a small angle α and a long finger 30. For hard soil where a shallow rib at long intervals is desired, a large angle α with a short finger 30 can be used. Thus, the present invention is adaptable to a variety of soil conditions.

Figure 6A:
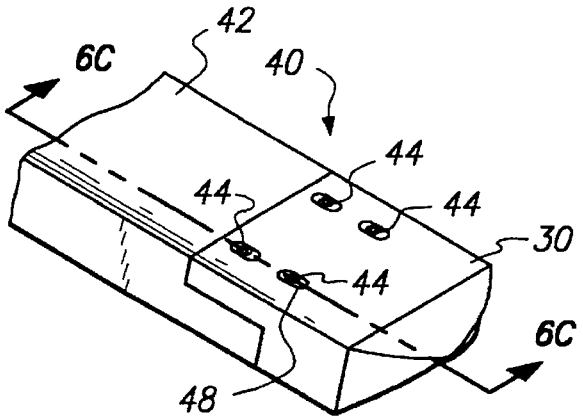
FIG. 6A is a partial perspective side view of the shear blade and extendible finger that provides adjustment of the overall length of the shear blade.
Figure 6B:
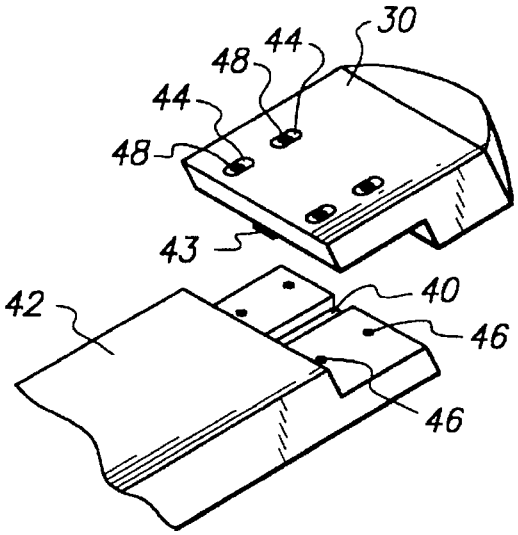
FIG. 6B is an exploded perspective side view of a portion of the shear blade and extendible finger that provides adjustment of the overall length of the shear blade.
Figure 6C:
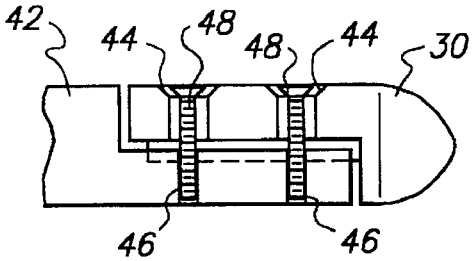
FIG. 6C is a partial cross-sectional side view of the shear blade and extendible finger that provides adjustment of the overall length of the shear blade.

As shown in FIGS. 6A and 6B, the shear blade 22 preferably provides a means to adjust the diameter of the pile of soil loosened by the shear blade 22. In the embodiment shown in FIGS. 6A and 6B, the shear blade 22 comprises a base blade member 42 and a finger 30. The base blade member 42 has a generally rectangular plate shape. The end of the base blade member 42 distal the shaft 12 has a stepped shape with a central groove 40 that extend over the stepped surface along the longitudinal axis of the base blade member 42. The end of the base blade member 42 preferably has a thickness about half of the remaining portion of the base blade member 42. The step on the base blade member 42 accommodates and receives a corresponding stepped portion of the finger 30. All the fingers 30 have the corresponding step portion such that when the finger 30 is mounted to the base blade member 42, the finger 30 extends the generally rectangular shape of the shear blade 22. Along the longitudinal axis of the finger 30, there is a protrusion 43. The protrusion is sized to mate with the groove 40 of the base blade member 42. Near the edges of the finger 30, there are a pairs of slots 44. The slots 44 preferably extend along a line parallel to the longitudinal axis of the base blade member 42 and the finger 30. The slots 44 are used to accommodate screws 48 that attach the finger 30 to the base blade member 42. There are four corresponding holes 46 in the base blade member 42 for receiving and mating with the screw 48 that extend through the finger 30. As shown best in FIG. 6C, each of the holes 46 have threads that mate with threads on the screws 48. In the preferred embodiment, four screws 48 are used to fasten the finger 30 to the base blade member 42. This configuration is advantageous because a variety of fingers 30 of different lengths may be used with the base blade member 42. For example, the present invention provides two primary types: one type for hard soil where the finger 30 has a length such that Δd is between 1/80 to 1/40 of diameter (dc) and a second type for soft soil where the finger 30 has a length such that Δd is between 1/20 and 1/10 of diameter (dc). Further fine adjustment of the overall length of the base blade member 42 and finger 30 is provided by the slots 46 in the finger 30. In addition to the different length fingers 30, different types of tips 32, 34, 36, 38 appropriate for the soil conditions can be utilized and changed as needed.

Figure 7A:
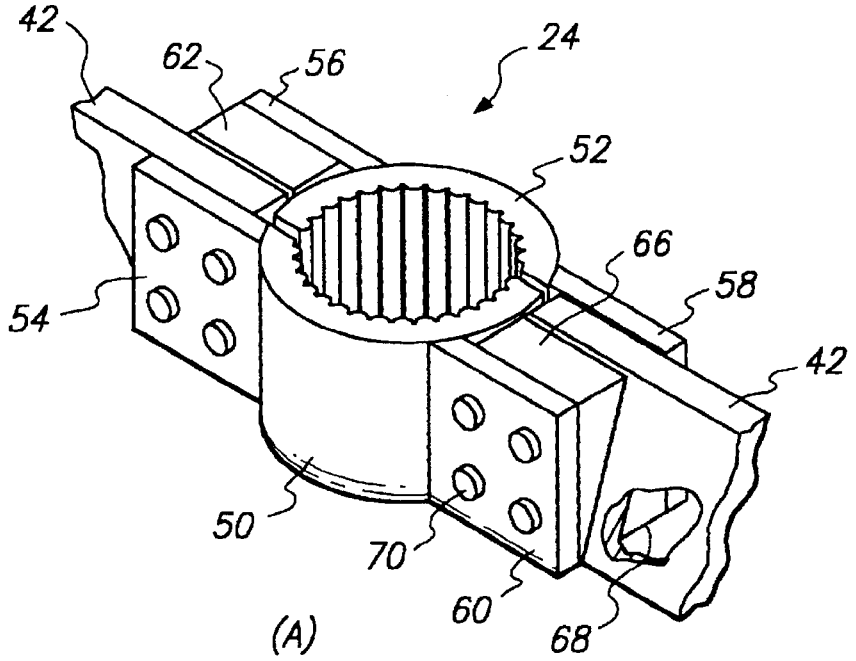
FIG. 7A is a perspective view of a first embodiment of a housing and the shear blade that provide adjustment of the angle of the shear blade with respect to a horizontal plane.

Referring now to FIG. 7A, the attachment of the shear blade 22 to the first embodiment of the housing 24 is shown in more detail. The present invention advantageously allows the angle α to be adjusted depending the soil conditions in which the apparatus 10 is used. The first embodiment of the housing 24 comprises a first and a second cylindrical halves 50, 52, a plurality of flanges 54, 56, 58, 60, and a plurality of taper pins 62, 64, 66, 68. The two cylindrical halves 50, 52 are mounted together as shown in FIG. 7A to provide a close fit about the shaft 12 in between the upper and lower supports 26, 28. The flanges 54, 56, 58, 60 are mounted parallel to the plane of the longitudinal axis of the cylinder. Two flanges 54 and 60, 56 and 58 are mounted to each cylindrical half 50, 52, respectively. Each flange 54, 56, 58, 60 is positioned on an opposite site of the cylinder formed by the halves 50, 52. The flange 54 of the first half 50 is parallel to and mounts with the flange 56 of the second half 52. Similarly, the other flange 60 of the first half is parallel to and mounts to the other flange 58 of the second half 52. Each of the flanges 54, 56, 58, 60 define a plurality of holes. The holes receive bolts 70 that attach the flanges 54 and 56, 58 and 60 together with nuts 72. As shown in FIG. 7A, the inner wall of the cylinder formed by the first and second cylindrical halves 50, 52 has a rough surface with longitudinal ripples. There are preferably corresponding ripples on the exterior surface of shaft 12 over which the halves 50, 52 are mounted. These ripples ensure there will be some translation of rotation force through friction from the shaft 12 to the shear blade 22.

Figure 7B:
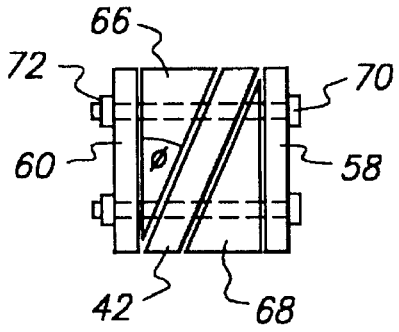
FIGS. 7B and 7C are sectional side views of the first embodiment of the housing and the shear blade in two different angled positions with respect to a horizontal plane.
Figure 7C:
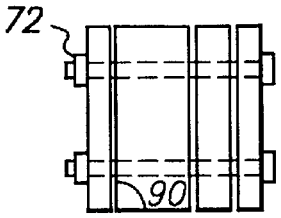
Figure 7D:
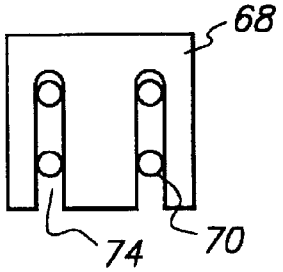
FIG. 7D is a side view of the preferred embodiment for the taper pin of the present invention.

As best shown in FIG. 7B, the taper pins 66, 68 and the base blade member 42 are clamped together between the flanges 58 and 60 when the halves 50, 52 are mounted together. The taper pins 66, 68 and the base blade member 42 similarly have a plurality of holes for receiving the bolts 70 that hold the halves 50, 52 together. The present invention advantageously allows the angle α of the shear blade 22 to be adjusted by using taper pins 66, 68 that position the base blade member 42 at different positions. For example, the amount of taper can be set to be an angle ϕ. The angle ϕ corresponds to the angle α. As shown in FIGS. 7C and 7B, the angle of the member 42 may be between 0° (no taper) and 45° (the greatest amount of taper) where the blade members 42 extends from one corner of the flange 58 to the opposite comer of flange 60. As shown in FIG. 7D, the taper pins 62, 64, 66, 68 preferably define slots 74 for receiving the bolts 70. These slots 74 allow the pins 62, 64, 66, 68 to be easily interchanged to adjust the angle of the blade 22 as needed.

Figure 8A:
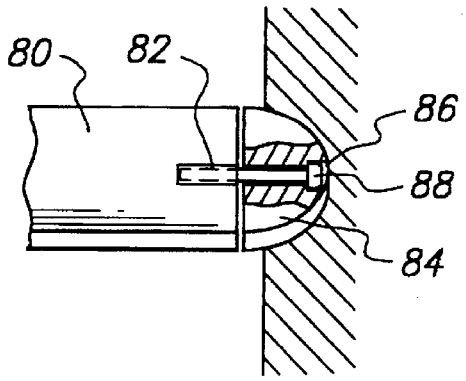
FIGS. 8A and 8B are perspective side views of a second embodiment for the shear blade and extendible finger.
Figure 8B:
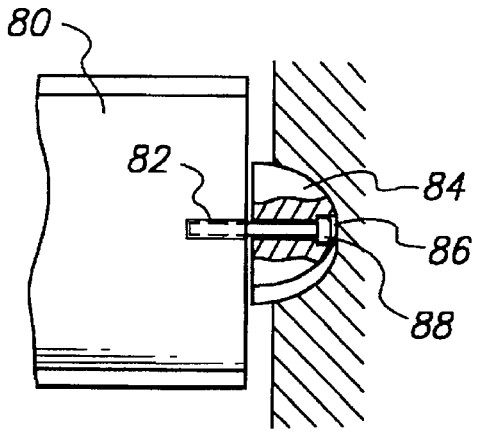
Figure 8C:
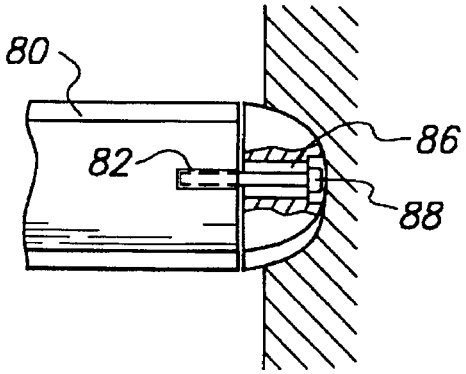
FIG. 8C is a perspective side view of a third embodiment for the shear blade and extendible finger.
Figure 8D:
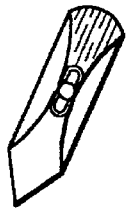
FIG. 8D is an end view of a extendible finger of the second and third embodiments.

Referring now to FIGS. 8A–8D, a second and third embodiment for the fingers 84 and the base blade member 80 of shear blade 22 are shown. In the second embodiment shown in FIGS. 8A and 8B, the base blade member 80 has a generally rectangular shape. A hole 82 is defined along the longitudinal axis of the base blade member 80 beginning from the end distal the shaft 12. The base blade member 80 preferably has a length about the same as the cutting blades 14, 16. In the second embodiment, each finger 84 has a semi-disk shape. The thickness of the finger 84 gradually increases from the rounded edge of the disk to a base with the same thickness as the base blade member 80. The finger 84 preferably defines a cavity 86 for receiving a bolt 88. The bolt 88 is used to mount the finger 84 to the base blade member 80. One end of the bolt 88 is threaded to mate with threads defined in the hole 82 of the base blade member 80. The other end extends into the cavity 86 and has a head that holds the bolt 88 and the finger 84 together while allowing the finger 84 to rotate about the longitudinal axis of the bolt 88. This configuration is particularly advantageous because it eliminates any undue stress on the shear blade 22. The rotatability of the finger 84 permits the finger 84 to find the path (i.e. angle) of least resistance as the apparatus 10 drills down into the ground. As shown in FIG. 8B, the finger 84 preferably has the same size despite changes in the size of the base blade member 80A. In the third embodiment, the cavity 86 is modified to have a slotted shape as shown in FIG. 8C. This modification allows the finger 84 to move vertically according to whether the apparatus 10 is drilling downward or being withdrawn. The movement of the finger 84 vertically provides further flexibility for applying the appropriate amount of force on the shear blade 22 and finger 84. A modification to the second and third embodiments is shown in FIG. 8D. As shown, the finger 84 may be modified in shape. While retaining its semi-disk shape, the second modification eliminates the symmetry of the finger 84. As shown in FIG. 8D, the second modification to the finger 84 provides a sharp semi-circular cutting edge on the downward side while having a dull, rounded, semi-circular edge on the top side. This is particularly advantageous because the sharp edge is beneficial and need when drilling into the soil and creating ribs. However, when the apparatus 10 is withdrawn, it is advantageous for the finger 84 to follow the rib that was created during the downward drilling process. With the modification, the finger 84 remains in the existing ribs as the apparatus 10 is removed from the ground.

Figure 9:
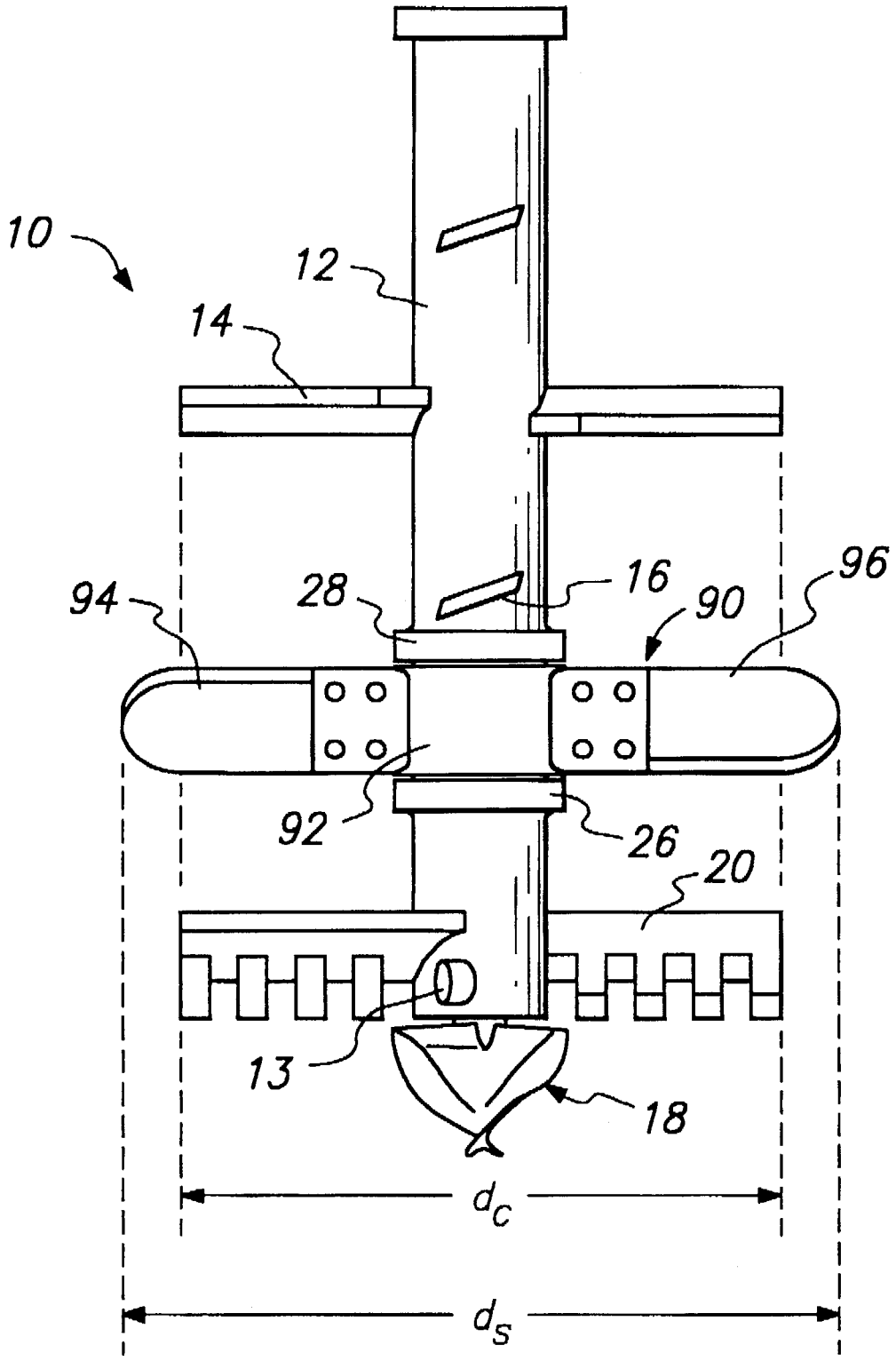
FIG. 9 is a front perspective view of the drilling apparatus of the present invention including a second embodiment of the housing and a second embodiment of the shear blade.

Referring now to FIG. 9, a front perspective view of the drilling apparatus 10 including a second embodiment of the shear blade 90 is shown. For convenience and ease of understanding like reference numerals have been used for the second embodiment of FIG. 9 for like parts from FIGS. 1–8. As with the first embodiment of the shear blade 22, the second embodiment of the shear blade 90 is mounted about the shaft 12 such that the shear blade 90 is free to rotate. The shear blade 90 is preferably mounted between the cutting blade 16 and the excavation blade 20, and functions in a similar manner to the first embodiment. The second embodiment of the shear blade 90 preferably comprises a second embodiment of a housing 92 and a first and second arm members 94, 96. The second embodiment of the housing 92 provides for a close fit about the shaft. 12. The housing 92 is maintained at a fixed longitudinal position along the shaft 12, while being free to rotate about the shaft 12, by the lower support 26 and the upper support 28.

In contrast to the first embodiment, the first arm member 94 and the second arm member 96 of the second embodiment of the shear blade 90 are preferably each formed from a single of piece of material. The preferred embodiment for the first arm member 94 is a rectangular beam with a first end rounded to form a semi-circular shape shown in FIG. 9. The second arm member 96 has a similar shape. Those skilled in the art will realize that the first ends of the first and second arm members 94, 96 may have a variety of shapes other than semi-circular, such as those shapes that have been described above for the tips of the fingers with reference to FIGS. 4A–4D. The second ends of the first and second arm members 94, 96 are used to mount the arm members 94, 96 to the housing 92. The first and second arm members 94, 96 are mounted such that they extend radially outward away from the shaft 12 and the housing 92 in opposite directions. This configuration is particularly advantageous because it makes the drilling system 10 much easier to manufacture. Moreover, the second embodiment of the shear blade 90 continues to allow the resistance of the shear blade 90 to be varied to meet the requirements of the soil conditions to provide proper mixing and rotation of the shear blade 90, and the creation of ribs, at the desired rate. By varying the overall lengths of the first and second arm members 94, 96, the difference in the area ($\pi * d_s^2$) of the column for shear blade 90 as compared to the area ($\pi * d_c^2$) of the column other blades 14, 16, 20 ($d_s$ vs. $d_c$) can be varied. The amount by which the shear blade 90, and thus the lengths of the arm members 94, 96, are greater than the cutting blades 14, 16 can be set according to the soil conditions and the rotation rate of the shear blade 90 desired. Adjustment in the length of the arm members 94, 96 can be accomplished by removing the first and second am members 94, 96 and replacing them with first and second arm members 94, 96 with a different length.

Figure 10:
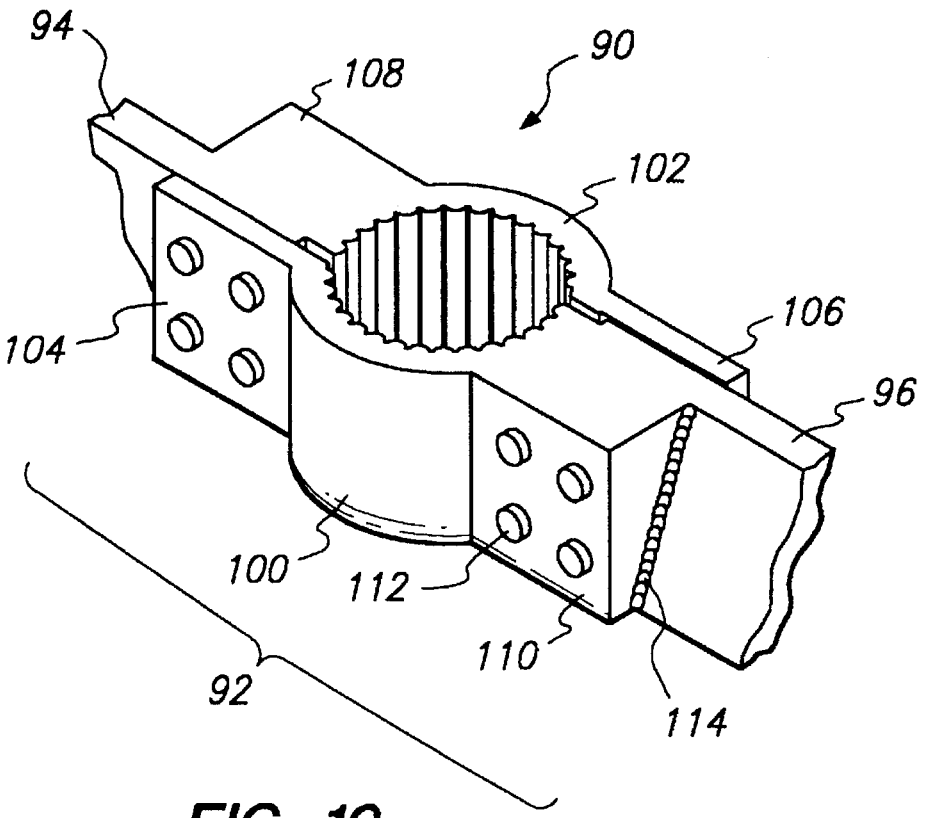
FIG. 10 is a perspective view of the second embodiment of the housing and attached arm members according to the second embodiment of the shear blade.

Referring now to FIG. 10, the attachment of the first and second arm members 94, 96 of the second embodiment of the shear blade 90 to the housing 92 is shown in more detail. In the second embodiment, the present invention continues to advantageously allows the angle $\alpha$ to be adjusted depending the soil conditions in which the apparatus 10 is used. This angle $\alpha$ can be adjusted by changing the angle at which the first and second arm members 94, 96 are attached to the housing 92. The housing 92 comprises a first and a second cylindrical halves 100, 102, a pair of flanges 104, 106, and a pair of mounting blocks 108, 110. The two cylindrical halves 100 and 102 are mounted together as shown in FIG. 10 to provide a close fit about the shaft 12 in between the upper and lower supports 26, 28. When mounted together, the two cylindrical halves 100 and 102 from a ring. The flanges 104, 106 and mounting blocks 108, 110 are mounted parallel to the plane of the longitudinal axis of the ring or cylinder. The flange 104 is mounted to a first end of the cylindrical half 100, and the first mounting block 110 is mounted proximate a second end of the cylindrical half 100, the second end being distal to the first end. Cylindrical half 102 similarly has flange 106 mounted at a first end and the mounting block 108 mounted proximate a second end of the cylindrical half 102. The flange 104 of the first half 100 is parallel to and mounts with the mounting block 108 of the second half 102. Similarly, the flange 106 of the second half 102 is parallel to and mounts to with the mounting block 110 of the first half 110. Each of the flanges 104 and 106 define a plurality of holes, that extend through the flanges 104, 106. Each of the mounting blocks 108, 110 define a corresponding set of holes that extend through each mounting block 108, 110. The holes receive bolts 112 that attach the flanges 104, 106 to the mounting blocks 108, 110, respectively, together with nuts 112. Each of the mounting blocks 108, 110 preferably has a substantially square shape. The sides of the mounting blocks 108, 110 are about the same dimensions as the height of the arm members 94, 96. This allows the arm members 94, 96 to be mounted to the mounting blocks 108, 110 at a variety of angles between zero and ninety degrees. For example, the arm members 94, 96 are shown mounted to the mounting blocks 108, 110, respectively, at an angle of about 60 degrees. The arm members 94, 96 are preferably mounted to the mounting blocks 108, 110 by welding 114 such as arc welding. Thus, arm member 94, 96 of various lengths can be mounted an removed using the welding process. As further shown in FIG. 10, the inner wall of the cylinder formed by the first and second cylindrical halves 100, 102 has a rough surface with longitudinal ripples. There are preferably corresponding ripples on the exterior surface of shaft 12 over which the halves 100, 102 are mounted. These ripples ensure there will be some translation of rotation force through friction from the shaft 12 to the shear blade 90.

Figure 11A:
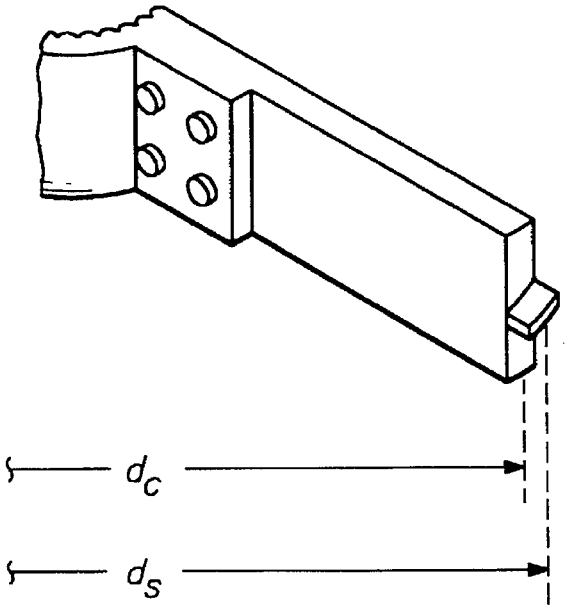
FIG. 11A is a perspective view of the third embodiment of the housing and an attached arm member and extensible finger.
Figure 11B:
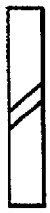
FIG. 11B is an end view of the arm member and extensible finger of FIG. 11A.

Referring now to FIG. 11A, a perspective view of the third embodiment of the housing and an attached arm member having art extensible finger or tip is shown. The third embodiment of the housing is similar to the second embodiment in that the housing is an integral part of the blade. However, in this third embodiment the housing has a mounting block that is reduced in sized, and the arm member of the shear blade lies in a vertical plane. FIG. 11A also illustrates how the distal ends of the arm members in the second and third embodiments may be shaped to provide tips like those illustrated in FIGS. 4A–4D. However, for the third embodiment, the housing, arm member and tip are preferably formed from a single piece of steel, for example. In such a configuration, the arm member is welded to the housing at the angle desired, and a tip having a desired length and shape is welded to the end of the arm member opposite the housing. FIG. 11A also illustrates how the rotation speed of the shear blade can be set by varying the length of the tip thereby changing the difference between $d_c$ and $d_s$. FIGS. 11A and 11B also shows how the tip may have a generally rectangular shape and be mounted to the blade at an angled position with respect to a horizontal plane orthogonal to the longitudinal axis of the shaft 12. The tip is preferably mounted at an angle about 30 degrees from the horizontal plane as shown. As is best seen in FIG. 11B, the angled position of the tip provides yet another means for varying the rotation speed of the shear blade with respect to the cutting blades since a tip mounted in a flat position (lying more in the horizontal plane) will provide less resistance to rotation than a tip mounted in an upright position (lying more in a vertical plane).

Having described the present invention with reference to specific embodiments, the above description is intended to illustrate the operation of the preferred embodiments and is not meant to limit the scope of the invention. For example, the angle and diameter of the shear blade may also be adjusted by welding the various length shear blades at the desired angles. The scope of the invention is to be limited only by the following claims. From the above discussion, many variations will be apparent to one skilled in the art that would yet be encompassed by the true spirit and scope of the present invention.

What is claimed is:

1. A drilling apparatus for producing a pile with ribs, the drilling apparatus comprising:

a hollow shaft having a first and second ends, and a port proximate the first end;

an auger bit attached at the first end of the shaft to rotate with the shaft;

an excavation blade attached to rotate with the shaft, the excavation blade attached proximate the auger bit;

a cutting blade attached to rotate with the shaft; and a shear blade having a first end and a second end, the shear blade mounted about the shaft at a fixed longitudinal position such that the shear blade can rotate about a longitudinal axis of the shaft independent of rotation of the shaft, the length of the shear blade being greater than the excavation blade such that the first and second ends of the shear blade extend radially outward from the shaft beyond the excavation blade, and the first and second ends of the shear blade are each positioned in a plane angled from a horizontal plane, the first and second ends of the shear blade being adjustable in position between a position parallel to the horizontal plane and a position perpendicular to the horizontal plane.

2. The drilling apparatus of claim 1, wherein the shear blade is mounted to the shaft at a position in between the excavation blade and cutting blade.

3. The drilling apparatus of claim 2, wherein the diameter of the column of soil loosened by the shear blade is greater than the diameter of the column of soil loosened by the cutting blades by zero to 1/10 of the diameter of the column of soil loosened by the cutting blades.

4. The drilling apparatus of claim 3, wherein the shear blade has an end shaped to have a substantially a pyramid shape.

5. The drilling apparatus of claim 3, wherein the shear blade has an end shaped to have a semi-circular shape and converging to a single edge on the outermost radial side.

6. The drilling apparatus of claim 2, wherein the shear blade has a length such that the shear blade rotates at a rate an order of magnitude slower than the rotation rate of the cutting and excavation blades.

7. The drilling apparatus of claim 2, wherein the shear blade comprises a plurality of arm members each having a generally rectangular shape with one end being semi-circular.

8. The drilling apparatus of claim 1, wherein the shear blade further comprises:

a housing having a generally cylindrical shape with an inner diameter slightly greater that the outer diameter of the shaft;

a first pair of blade members attached to the housing and extending radially outward in opposite directions; and a first and second supports mounted to the shaft, the first and second supports being circular bands with outer diameters greater than the inner diameter of the housing, the first and second supports mounted along the shaft on opposite sides of the housing to prevent the housing from moving along the longitudinal axis of the shaft.

9. The drilling apparatus of claim 8, wherein the housing further comprises:

a first cylindrical half having ends and an inner side, a first flange and a first mounting block attached to opposite ends of the first cylindrical half and extending in opposite directions radially outward from the shaft, the inner side of the first cylindrical half having a toughened surface for resistance with rotation of the shaft; and a second cylindrical half having ends and an inner side, a second flange and a second mounting block attached to opposite ends of the second cylindrical half and extending in opposite directions radially outward from the shaft, the inner side of the second cylindrical half having a roughened surface for resistance with rotation of the shaft.

10. The drilling apparatus of claim 9, wherein the mounting blocks are sized with respect to the height of the blade members such that the blade members can be mounted to lie in planes with different angles with respect to a horizontal plane.

11. The drilling apparatus of claim 10, wherein the blade members are mounted to a respective mounting block by welding.

12. The drilling apparatus of claim 10, wherein the angle of the plane in which the cutting blade lies is adjustable with respect to a horizontal plane.

13. The drilling apparatus of claim 12, wherein the angle of the plane in which the shear blade lies with respect to a horizontal plane is such that the shear blade rotates at a rate an order of magnitude slower than the rotation rate of the cutting and excavation blades.

14. The drilling apparatus of claim 8, further comprising a second pair of blade members having a length different than the first pair of blade members, the second pair of blade members being alternatively mounted to the housing instead of the first pair of blade members.

* * * * *